US009440129B2

(12) United States Patent
Gaerlan

(10) Patent No.: US 9,440,129 B2
(45) Date of Patent: Sep. 13, 2016

(54) ANIMAL SHAPED GOLF BAG

(71) Applicant: Graal Umangil Gaerlan, El Segundo, CA (US)

(72) Inventor: Graal Umangil Gaerlan, El Segundo, CA (US)

( * ) Notice: Subject to any disclaimer, the term of this patent is extended or adjusted under 35 U.S.C. 154(b) by 217 days.

(21) Appl. No.: 14/461,049

(22) Filed: Aug. 15, 2014

(65) Prior Publication Data

US 2015/0047997 A1 Feb. 19, 2015

Related U.S. Application Data

(60) Provisional application No. 61/866,259, filed on Aug. 15, 2013.

(51) Int. Cl.
*A63B 55/00* (2015.01)
*A63H 3/00* (2006.01)

(52) U.S. Cl.
CPC ..... *A63B 55/008* (2013.01); *A63B 55/00* (2013.01); *A63B 55/408* (2015.10); *A63H 3/005* (2013.01); *A63B 2209/10* (2013.01)

(58) Field of Classification Search
CPC .. A63B 55/008; A63B 55/408; A63B 55/00; A63B 2209/10; A63H 3/005
See application file for complete search history.

(56) References Cited

U.S. PATENT DOCUMENTS

| | | | | |
|---|---|---|---|---|
| 5,450,954 | A * | 9/1995 | Dunn | A63B 57/00 206/315.3 |
| 5,551,569 | A * | 9/1996 | Garvin-Mazzarisi | B65F 1/14 206/457 |
| 5,855,276 | A * | 1/1999 | Smith, Jr. | A45C 13/08 150/117 |
| 6,330,944 | B1 * | 12/2001 | DeMichele | A63B 55/60 206/278 |
| 7,152,279 | B2 * | 12/2006 | Elliott | A63B 57/60 24/3.1 |
| 7,743,916 | B2 * | 6/2010 | Roberts, II | A63B 55/00 150/159 |
| 2011/0031143 | A1 * | 2/2011 | Lindeman | A63B 55/00 206/315.4 |
| 2014/0374300 | A1 * | 12/2014 | Espinosa | B65F 1/163 206/457 |

* cited by examiner

*Primary Examiner* — Tri Mai

(57) ABSTRACT

An animal-shaped golf bag is a golf bag that houses, transports, and protects golf clubs and additional items. In addition to maintaining the original functionality of a golf bag, the animal-shaped golf bag additionally provides the aesthetic appearance of an animal. The animal-shaped golf bag features a main animal-shaped body with a club-receiving cavity for storing golf clubs. A rigid base is provided for stability when resting on a surface. A plurality of animal feature-shaped pockets is also present for storing the user's items and providing the aesthetic appearance of an animal. Additionally, the animal-shaped golf bag features a plurality of aesthetic ornaments and a plurality of aesthetic displays that further enhance the aesthetic appearance of an animal provided by the animal-shaped golf bag. The animal-shaped golf bag may be conveniently transported by means of a carry handle and a carry strap.

19 Claims, 7 Drawing Sheets

ANIMAL SHAPED GOLF BAG

The current application claims a priority to the U.S. Provisional Patent application Ser. No. 61/866,259 filed on Aug. 15, 2013.

FIELD OF THE INVENTION

The present invention relates generally to an animal-shaped golf bag. More specifically, the present invention is an animal-shaped golf bag that is utilized to house, transport, and protect golf clubs as well as various additional types of equipment.

BACKGROUND OF THE INVENTION

The sport of golf involves the use of golf clubs in order to strike a ball with the intent of placing the ball into a hole. Because of the nature of the sport and the variety of circumstances that a golfer may find himself or herself in, an individual golfer often possesses a large number of golf clubs. Golf clubs are generally categorized into woods, irons, and putters with various specialized golf clubs such as wedges and chippers found in common usage as well. Because of the numerous golf clubs a golfer may need during the course of a round, a golf bag is one of the most important pieces of equipment at the golfer's disposal. A golf bag includes an elongated hollow compartment that is divided into smaller segments for housing and protecting multiple golf clubs. The segmentation of the golf bag provides a level of organization for the golf clubs, allowing the golfer to quickly select the appropriate club as needed. In addition to golf clubs, the golfer generally possesses a variety of additional equipment that may be carried in a golf bag. Golf balls, ball markers, tees, divot tools, towels, and gloves are some common pieces of equipment that are essential to or may be needed during a round of golf. In addition to the elongated hollow compartment, a golf bag often features a large number of secondary pockets and compartments for storing miscellaneous pieces of equipment that may be needed during a round of golf. These secondary pockets and compartments are generally disposed along the exterior of the golf bag for easy access.

The present invention is an animal-shaped golf bag for use in housing, transporting, and protecting a golfer's golf clubs and additional equipment. The object of the present invention is to maintain the golf bag's original purpose and functionality while simultaneously providing a unique design and improving the aesthetic appeal of the golf bag. The present invention seeks to maintain the original intended functionality of housing, transporting, and protecting golf clubs and equipment as well as provide the unique aesthetic appearance of an animal.

DETAIL DESCRIPTIONS OF THE INVENTION

Figure 1:
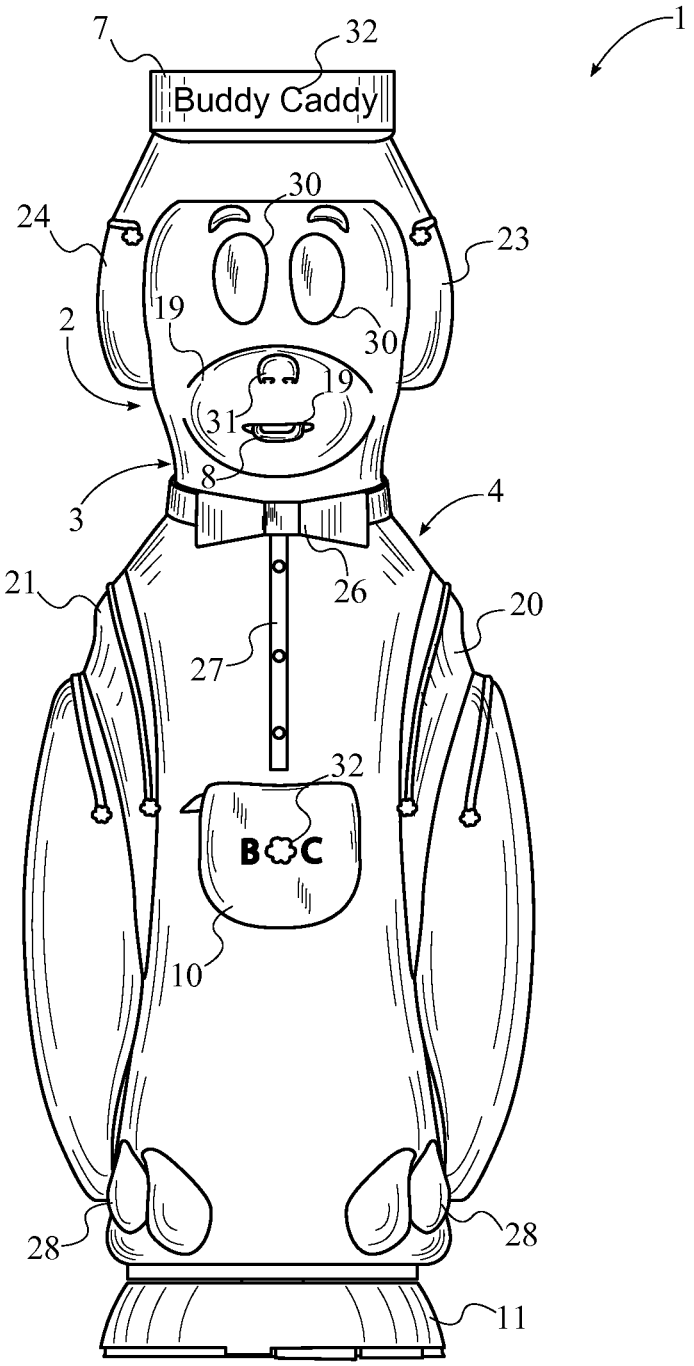
FIG. 1 is a front view of the present invention.
Figure 2:
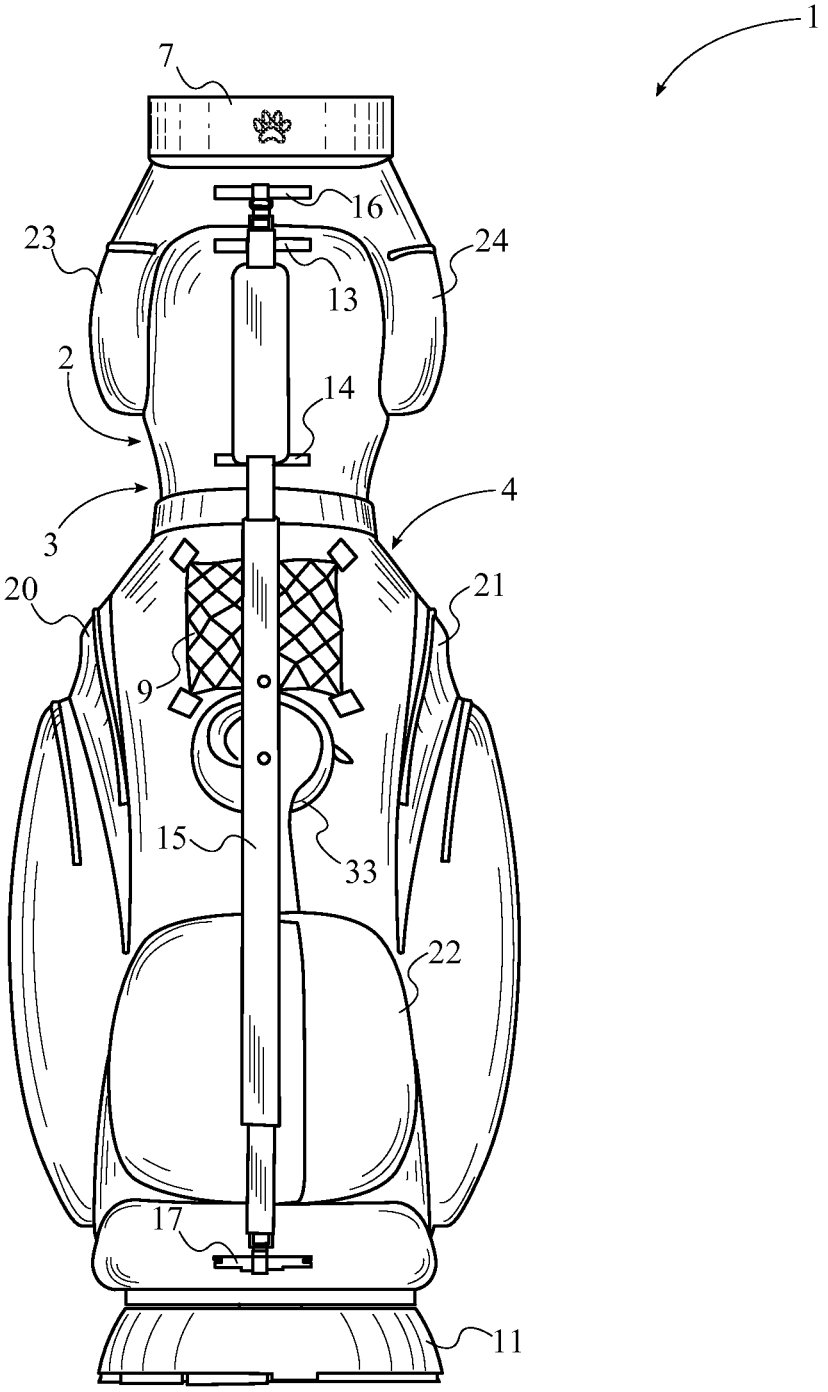
FIG. 2 is a rear view of the present invention.
Figure 3:
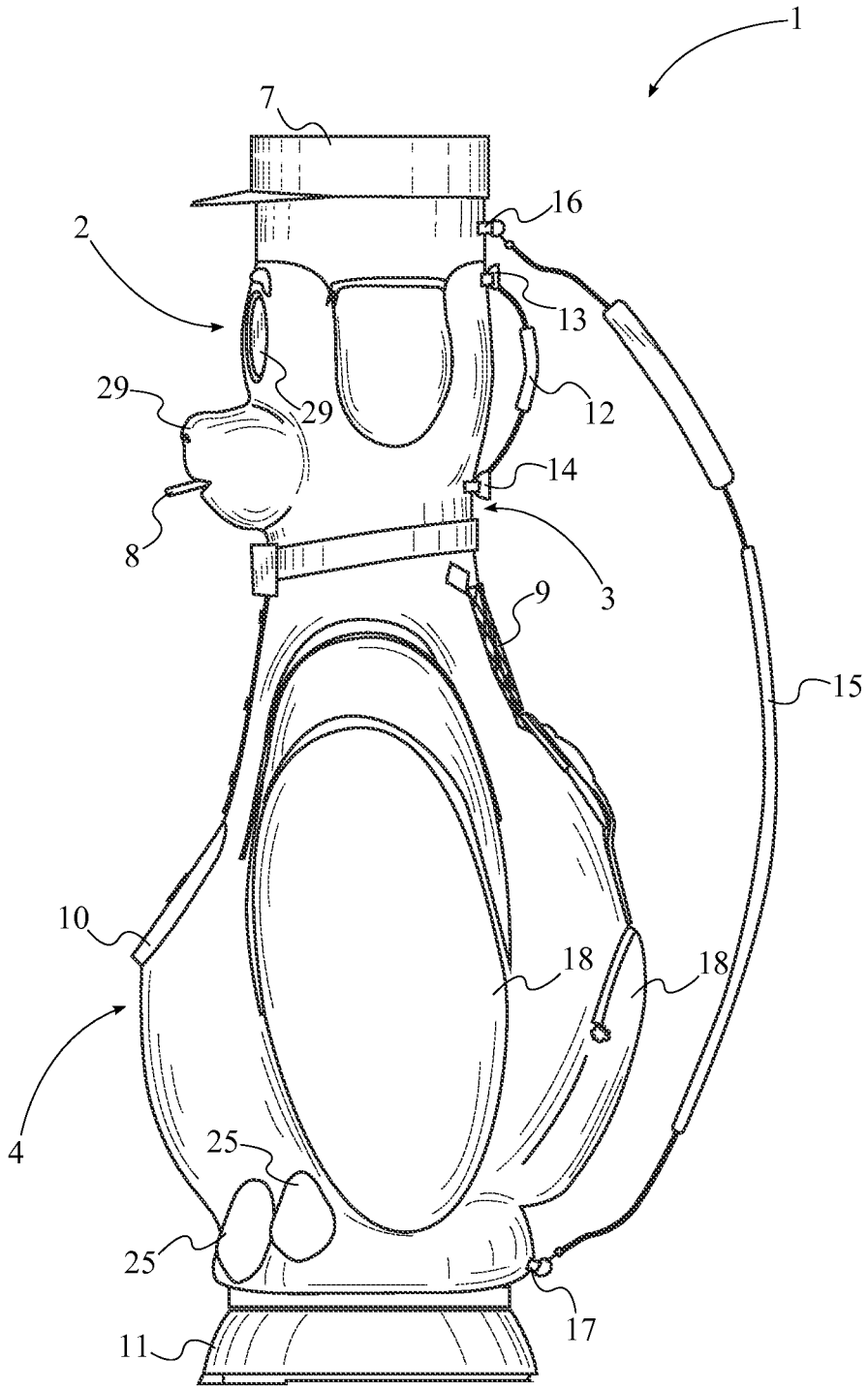
FIG. 3 is a left side view of the present invention.
Figure 4:
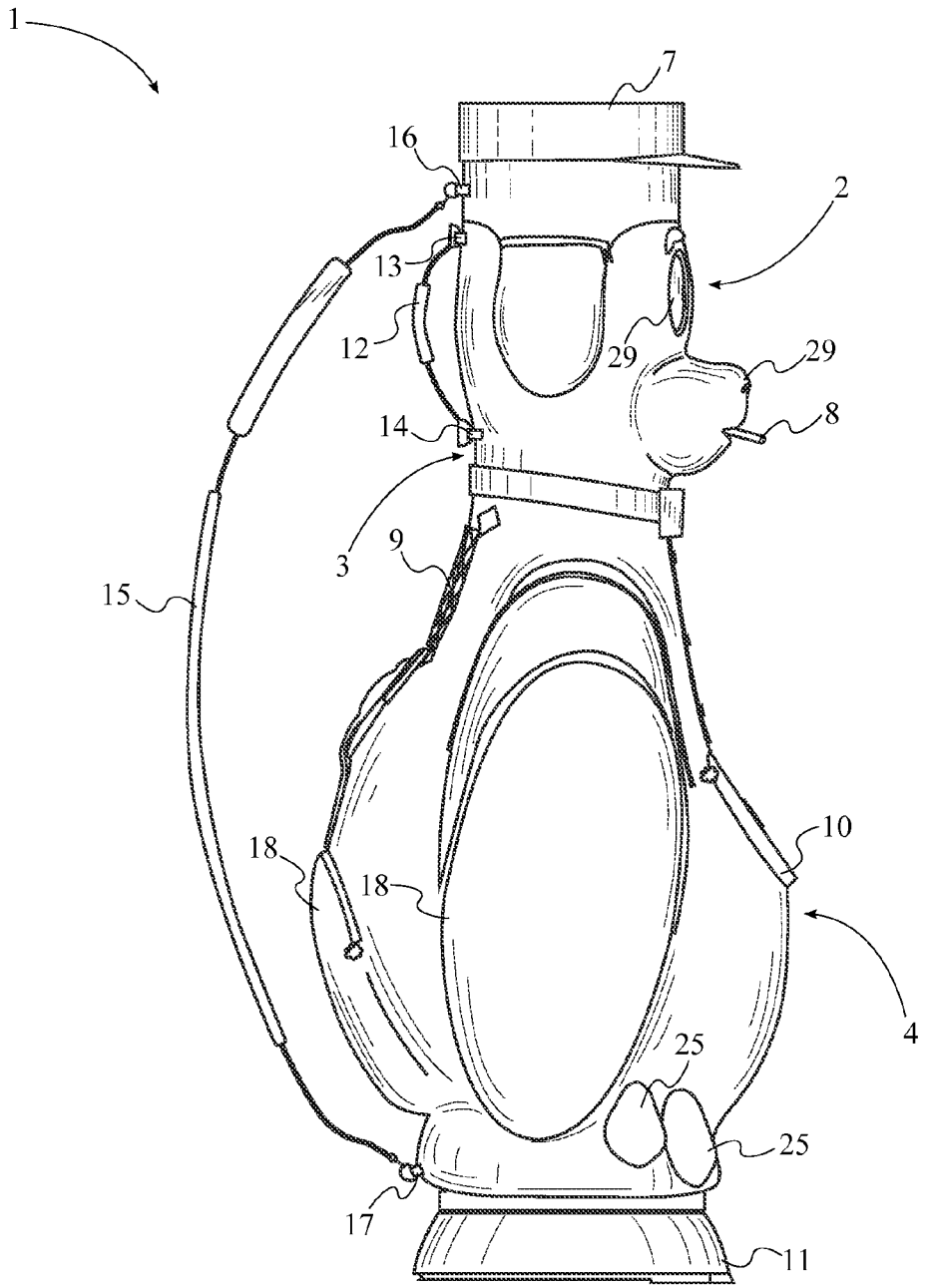
FIG. 4 is a right side view of the present invention.

All illustrations of the drawings are for the purpose of describing selected versions of the present invention and are not intended to limit the scope of the present invention.

The present invention is an animal-shaped golf bag for housing, transporting, and protecting golf clubs and additional equipment. The animal-shaped golf bag is shown in FIGS. 1-7. The animal-shaped golf bag comprises a main animal-shaped body 1, a visor-shaped divider 7, a towel holder 8, a dorsal mesh pocket 9, an insulated pocket 10, and a plurality of animal feature-shaped pockets 18. The present invention is designed to provide the aesthetic appearance of an animal while maintaining the intended functionality of a golf bag for housing, transporting, and protecting golf clubs and additional equipment.

Figure 5:
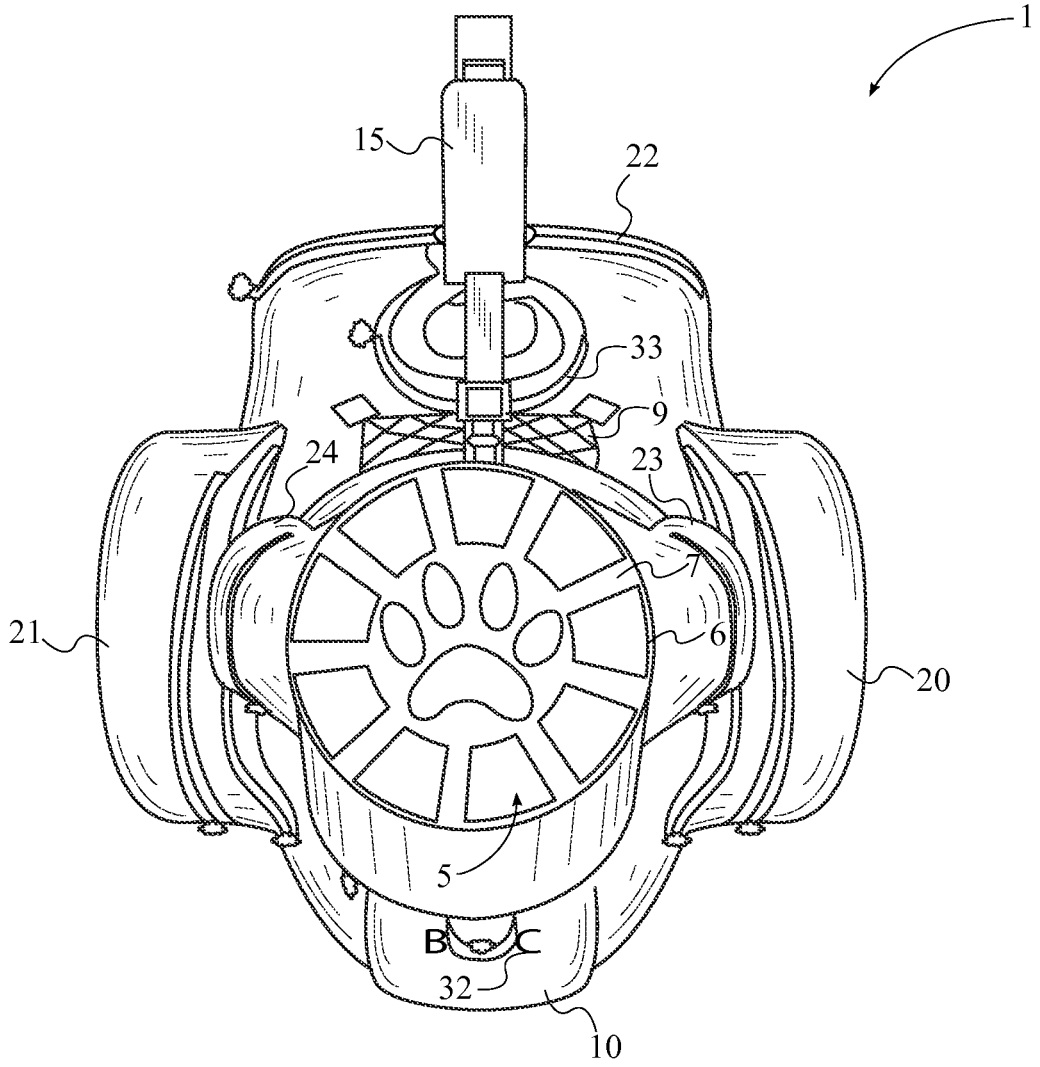
FIG. 5 is a top view of the present invention.

With reference to FIGS. 1-4 and FIG. 7, the main animal-shaped body 1 comprises a head-shaped portion 2, a neck-shaped portion 3, a torso-shaped portion 4, and a club-receiving cavity 5. The club-receiving cavity 5 comprises an opening 6 through which one or more golf clubs may be inserted. The opening 6 is positioned on the head-shaped portion 2. The club-receiving cavity 5 traverses from the head-shaped portion 2 to the torso-shaped portion 4 through the neck-shaped portion 3. The club-receiving cavity 5 is further of a sufficient height such that the club-receiving cavity 5 is capable of accommodating the handle and majority of the shaft of a golf club. A golf club may be inserted into the club-receiving cavity 5 handle end first with the club head and a portion of the shaft left to protrude from the club-receiving cavity 5. As shown in FIG. 5, the visor-shaped divider 7 is circumferentially mounted into the opening 6 and allows for organization of golf clubs that are inserted through the visor-shaped divider 7, such as based on the types of the individual golf clubs. The visor-shaped divider 7 further serves to enhance the aesthetic appearance of the real life animal that is being portrayed by the animal-shaped golf bag and provides the appearance of the animal wearing a visor. In addition, the individual segments of the visor-shaped divider 7 may comprise the design of an animal paw as shown in FIG. 5. The specific design of the visor-shaped divider 7 may vary across example embodiments of the present invention. Various other types of headwear may be mimicked by the visor-shaped divider 7 in additional embodiments of the present invention.

In addition to golf clubs, the animal-shaped golf bag is designed to house, transport, and protect additional types of golf equipment as well. The plurality of animal feature-shaped pockets 18 comprises a mouth-shaped pocket 19. The mouth-shaped pocket 19 features a means of opening and closing the mouth-shaped pocket 19 such as, but not limited to, a zipper, hook and loop fasteners, or a button. The towel holder 8 is retractably mounted into the mouth-shaped pocket 19 and may be extended from and retracted into the mouth-shaped pocket 19 as needed. When extended, the towel holder 8 protrudes from the mouth-shaped pocket 19 while conversely, when retracted, the towel holder 8 is entirely contained within the mouth-shaped pocket 19. The towel holder 8 features some means of retaining a towel in place such as, but not limited to, a hook or a clamp. The towel holder 8 is utilized to hold a towel, rag, cloth, or similar item on the exterior of the golf bag for convenient access and use in cleaning dirt, grass, and other debris from a golf club head. Additionally, when a towel is placed into the towel holder 8, the positioning of the towel holder 8 within the mouth-shaped pocket 19 provides the aesthetic appearance of an animal holding the towel in its mouth. The dorsal mesh pocket 9 is mounted onto the torso-shaped portion 4 and allows for air to flow freely in and out of the dorsal mesh pocket 9. The dorsal mesh pocket 9 may or may not feature a means of opening or closing the dorsal mesh pocket 9. Additionally, the dorsal mesh pocket 9 is elastic and is capable of holding various items. However, the open air nature of the dorsal mesh pocket 9 makes the dorsal mesh pocket 9 especially suitable for storing items such as golfing gloves for drying such as after the gloves have become damp due to sweat and other moisture. The insulated pocket 10 is mounted onto the torso-shaped portion 4 as well, opposite to the dorsal mesh pocket 9. The insulated pocket 10 may be utilized to store items such as food or drinks that the user wishes to retain at an initial hot or cold temperature for some period of time.

Figure 6:
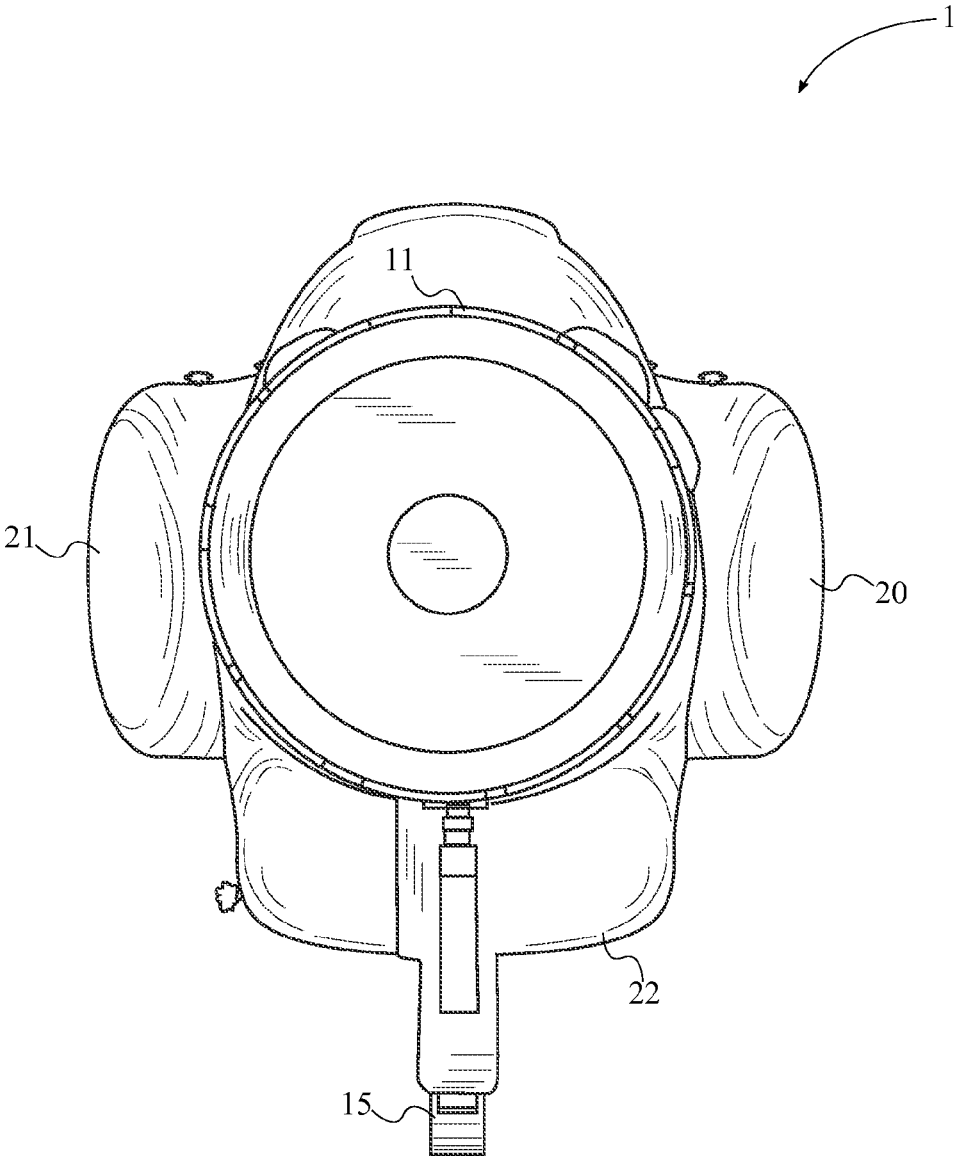
FIG. 6 is a bottom view of the present invention.
Figure 7:
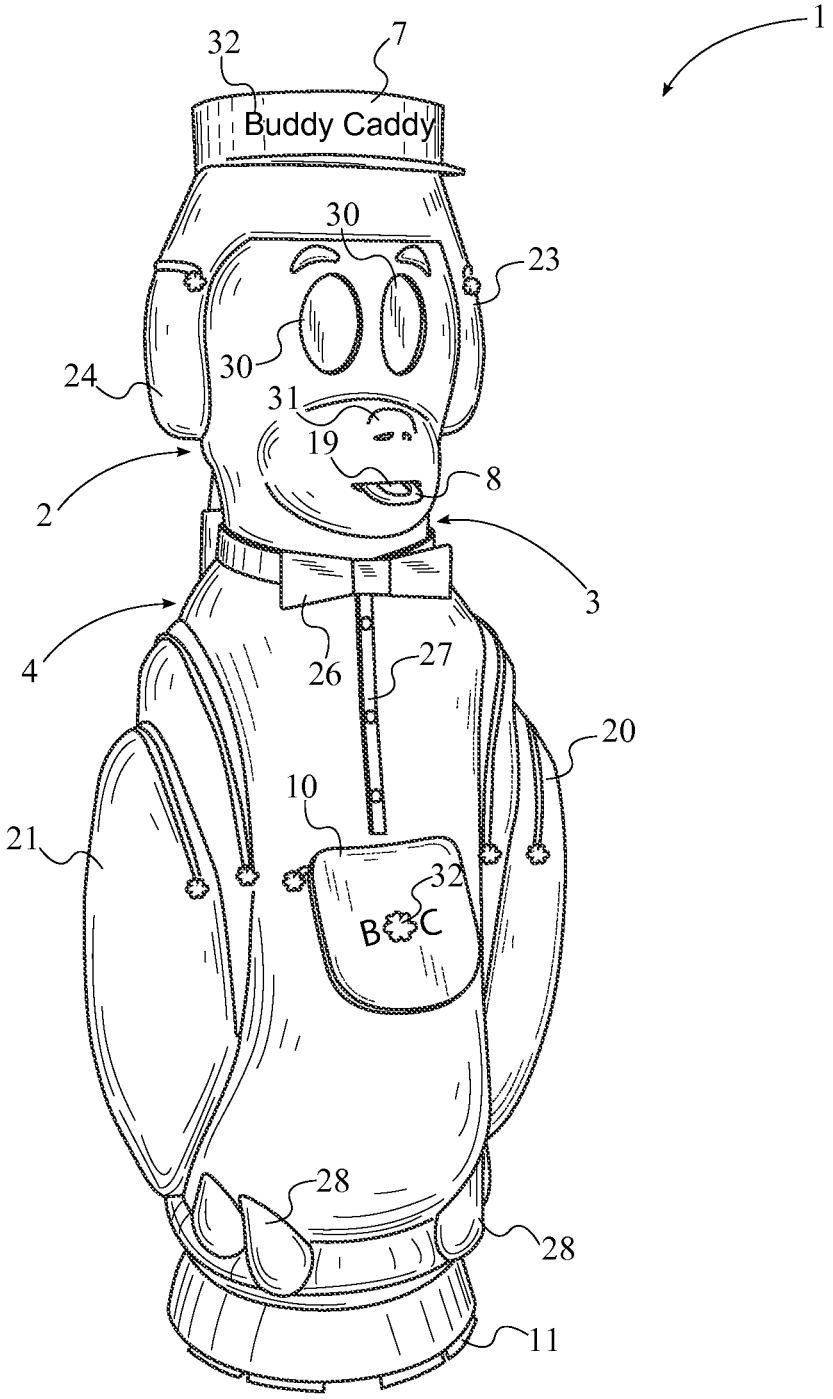
FIG. 7 is a perspective view of the present invention.

The present invention further comprises a rigid base 11. As shown in FIG. 6, the rigid base 11 is connected adjacent to the torso-shaped portion 4, opposite to the neck-shaped portion 3. During a round of golf, it is common for the animal-shaped golf bag to be placed onto a surface unattended when not in use. The rigid base 11 provides a stable foundation on which the animal-shaped golf bag may rest independent of any external structural support. In order to facilitate transportation of the animal-shaped golf bag, the animal-shaped golf bag further comprises a carry handle 12. The carry handle 12 comprises a first handle end 13 and a second handle end 14. The first handle end 13 is connected to the head-shaped portion 2 while the second handle end 14 is connected to the neck-shaped portion 3. The carry handle 12 provides a loop that the user may grasp in order to manually transport the animal-shaped golf bag during the course of a round of golf. In various example embodiments of the present invention, the carry handle 12 may be removable from the animal-shaped golf bag. The animal-shaped golf bag further comprises a carry strap 15. The carry strap 15 comprises a first strap end 16 and a second strap end 17. The first strap end 16 is removably attached to the head-shaped portion 2, adjacent to the visor-shaped divider 7. The second strap end 17 is removably attached to the torso-shaped portion 4, adjacent to the rigid base 11. The first strap end 16 and the second strap end 17 are connected to the two extremities of the present invention in order to allow the user to place the maximum width of the carry strap 15 over his or her shoulders. The first strap end 16 and the second strap end 17 are attachable to the animal-shaped golf bag utilizing a means such as, but not limited to, fastener clips. The user is able to utilize the carry strap 15 to carry the animal-shaped golf bag over his or her shoulders.

The plurality of animal feature-shaped pockets 18 further comprises at least one left shoulder-shaped pocket 20, at least one right shoulder-shaped pocket 21, a tail-shaped pocket 33, and a at least one hindquarter-shaped pocket 22. The at least one left shoulder-shaped pocket 20, the at least one right shoulder-shaped pocket 21, the tail-shaped pocket 33, and the at least one hindquarter-shaped pocket 22 are mounted onto the torso portion in order to provide convenient access to the user. Furthermore, the at least one right shoulder-shaped pocket 21 is positioned opposite to the at least one left shoulder-shaped pocket 20. The dorsal mesh pocket 9 is positioned in between the at least one left shoulder-shaped pocket 20 and the at least one right shoulder-shaped pocket 21. The tail-shaped pocket 33 is positioned in between the dorsal mesh pocket 9 and the rigid base 11. Finally, the at least one hindquarter-shaped pocket 22 is positioned between the tail-shaped pocket 33 and the rigid base 11. This configuration of the plurality of animal feature-shaped pockets 18 allows the present invention to anatomically resemble an animal.

The plurality of animal feature-shaped pockets 18 further comprises at least one left ear-shaped pocket 23 and at least one right ear-shaped pocket 24. The at least one left ear-shaped pocket 23 and the at least one right ear-shaped pocket 24 are mounted onto the head-shaped portion 2. Additionally, the at least one right ear-shaped pocket 24 is positioned opposite to the at least one left ear-shaped pocket 23. Each of the plurality of animal feature-shaped pockets 18 features a means of opening and closing such as, but not limited to, a zipper, hook and loop fasteners, or a button. The plurality of animal feature-shaped pockets 18 is utilized to house, transport, and protect various items that the user may need during a round of golf.

Because the animal-shaped golf bag is intended to present the aesthetic appearance of a real life animal, the plurality of animal feature-shaped pockets 18 may vary across multiple example embodiments of the present invention. As such, the plurality of animal feature-shaped pockets 18 may vary in terms of specific feature type based on the animal that is being represented.

In addition to housing, transporting, and protecting the user's golf clubs, golf equipment, and personal items, the animal-shaped golf bag is designed to provide the aesthetic appearance of an animal. As such, the animal-shaped golf bag further comprises a plurality of aesthetic displays 29. In the current embodiment of the present invention, the plurality of aesthetic displays 29 comprises a plurality of eye-shaped displays 30, a nose-shaped display 31, and at least one logo display 32. The plurality of eye-shaped displays 30 and the nose-shaped display 31 are designed to mimic the eyes and nose of the real life animal that is aesthetically depicted by the animal-shaped golf bag. The plurality of eye-shaped displays 30 is mounted adjacent to the mouth-shaped pocket 19. The nose-shaped display 31 is mounted in between the plurality of eye-shaped displays 30 and the mouth-shaped pocket 19. Finally, the at least one logo display 32 is mounted onto the insulated pocket 10. However, the present invention is not limited with respect to the specific positioning of the at least one logo display 32 and in various example embodiments of the present invention, the at least one logo display 32 may be positioned elsewhere on the animal-shaped golf bag. In the current embodiment of the present invention, the plurality of aesthetic displays 29 enhances the aesthetic appearance of the real life animal that is being portrayed by the animal-shaped golf bag. The plurality of aesthetic displays 29 may be drawn, stitched, or otherwise connected to the animal-shaped golf bag.

The animal-shaped golf bag further comprises a plurality of aesthetic ornaments 25. Similar to the plurality of aesthetic displays 29, the plurality of aesthetic ornaments 25 enhances the aesthetic appearance of the real life animal that is being portrayed by the animal-shaped golf bag. In the current embodiment of the present invention, the plurality of aesthetic ornaments 25 comprises a bowtie 26, a plurality of animal feet-shaped ornaments 28, and a button-down shirt-shaped ornament 27. The bowtie 26 is circumferentially and removably attached to the neck-shaped portion 3. The bowtie 26 may be removed and replaced in order to increase the customizability of the animal-shaped golf bag. The bowtie 26 provides the aesthetic appearance of an animal wearing a bowtie 26. Although the plurality of aesthetic ornaments 25 is designed to enhance the aesthetic appearance of the animal-shaped golf bag, in various example embodiments of the present invention, the bowtie 26 may feature a pocket for housing, transporting, and protecting various items. The plurality of animal feet-shaped ornaments 28 is mounted adjacent to the rigid base 11. The button-down shirt-shaped ornament 27 is mounted onto the torso-shaped portion 4. Furthermore, the button-down shirt-shaped ornament 27 traverses from the bowtie 26 to the insulated pocket 10 and provides the aesthetic appearance of an animal wearing a button-down shirt. The button-down shirt-shaped ornament 27 may feature physical buttons that are attached to the animal-shaped golf bag or buttons that are simply drawn, painted, patterned, or embroidered onto the animal-shaped golf bag to imitate the appearance of physical buttons.

In certain situations, the animal-shaped golf bag may be utilized in conjunction with various peripheral accessories such as a carry case and a rain hood. A carry case is utilized to transport the animal-shaped golf bag as well as protect the animal-shaped golf bag, golf clubs, and other items within the animal-shaped golf bag. The carry case may comprise a protective outer shell as well as a means of fastening the carry case to the animal-shaped golf bag. Additionally, the carry case is specifically designed to accommodate the animal-shaped golf bag. The carry case may comprise a transparent window through which the head-shaped portion 2, the plurality of eye-shaped displays 30, the nose-shaped display 31, and the mouth-shaped pocket 19 are visible. Finally, the carry case may comprise some means of facilitating transportation of the animal-shaped golf bag such as, but not limited to, a carry case handle and a plurality of wheels that allows the user to roll the animal-shaped golf bag along a surface without having to physically carry the animal-shaped golf bag. As its name implies, a rain hood is primarily utilized to prevent the animal-shaped golf bag from becoming wet in rainy environments. The rain hood comprises a flexible sheet of water-resistant or waterproof material that is specifically designed to fit over the animal-shaped golf bag. Additionally, the rain hood further comprises some means of fastening the rain hood to the animal-shaped golf bag.

Although the invention has been explained in relation to its preferred embodiment, it is to be understood that many other possible modifications and variations can be made without departing from the spirit and scope of the invention as hereinafter claimed.

What is claimed is:

1. An animal-shaped golf bag comprises:
a main animal-shaped body;
a visor-shaped divider;
a towel holder;
a dorsal mesh pocket,
an insulated pocket,
a plurality of animal feature-shaped pockets;
the main animal-shaped body comprises a head-shaped portion, a neck-shaped portion, a torso-shaped portion, and a club-receiving cavity;
the club-receiving cavity comprises an opening;
the club-receiving cavity traversing from the head-shaped portion to the torso-shaped portion through the neck-shaped portion;
the opening being positioned on the head-shaped portion;
the visor-shaped divider being circumferentially mounted into the opening;
the plurality of animal feature-shaped pockets comprises a mouth-shaped pocket;
the towel holder being retractably mounted into the mouth-shaped pocket;
the dorsal mesh pocket being mounted onto the torso-shaped portion; and
the insulated pocket being mounted onto the torso-shaped portion, opposite to the dorsal mesh pocket.

2. The animal-shaped golf bag as claimed in claim 1 further comprises:
a rigid base; and
the rigid base being connected adjacent to the torso-shaped portion, opposite to the neck-shaped portion.

3. The animal-shaped golf bag as claimed in claim 1 further comprises:
a carry handle;
the carry handle comprises a first handle end and a second handle end;
the first handle end being connected to the head-shaped portion; and
the second handle end being connected to the neck-shaped portion.

4. The animal-shaped golf bag as claimed in claim 1 further comprises:
a carry strap;
the carry strap comprises a first strap end and a second strap end;
the first strap end being removably attached to the head-shaped portion, adjacent to the visor-shaped divider; and
the second strap end being removably attached to the torso-shaped portion, adjacent to a rigid base.

5. The animal-shaped golf bag as claimed in claim 1 further comprises:
the plurality of animal feature-shaped pockets further comprises at least one left shoulder-shaped pocket, at least one right shoulder-shaped pocket, a tail-shaped pocket, and at least one hindquarter-shaped pocket; and
the at least one left shoulder-shaped pocket, the at least one right shoulder-shaped pocket, the tail-shaped pocket, and the at least one hindquarter-shaped pocket being mounted onto the torso-shaped portion.

6. The animal-shaped golf bag as claimed in claim 5 further comprises:
the at least one right shoulder-shaped pocket being positioned opposite to the at least one left shoulder-shaped pocket;
the dorsal mesh pocket being positioned in between the at least one left shoulder-shaped pocket and the at least one right shoulder-shaped pocket;
the tail-shaped pocket being positioned in between the dorsal mesh pocket and a rigid base; and
the at least one hindquarter-shaped pocket being positioned in between the tail-shaped pocket and the rigid base.

7. The animal-shaped golf bag as claimed in claim 1 further comprises:
the plurality of animal feature-shaped pockets further comprises at least one left ear-shaped pocket and at least one right ear-shaped pocket; and
the at least one left ear-shaped pocket and the at least one right ear-shaped pocket being mounted onto the head-shaped portion.

8. The animal-shaped golf bag as claimed in claim 7 further comprises:
the at least one right ear-shaped pocket being positioned opposite to the at least one left ear-shaped pocket.

9. The animal-shaped golf bag as claimed in claim 1 further comprises:
a plurality of aesthetic displays;
the plurality of aesthetic displays comprises a plurality of eye-shaped displays, a nose-shaped display, and at least one logo display;
the plurality of eye-shaped displays being mounted adjacent to the mouth-shaped pocket;
the nose-shaped display being mounted in between the plurality of eye-shaped displays and the mouth-shaped pocket; and the at least one logo display being mounted onto the insulated pocket.

10. The animal-shaped golf bag as claimed in claim 1 further comprises:

a plurality of aesthetic ornaments;

the plurality of aesthetic ornaments comprises a bowtie, a plurality of animal feet-shaped ornaments, and a button-down shirt-shaped ornament;

the bowtie being circumferentially and removably attached to the neck-shaped portion;

the plurality of animal-feet shaped ornaments being mounted adjacent to a rigid base;

the button-down shirt-shaped ornament being mounted onto the torso-shaped portion; and the button-down shirt-shaped ornament traversing from the bowtie to the insulated pocket.

11. An animal-shaped golf bag comprises:

a main animal-shaped body;

a visor-shaped divider;

a towel holder;

a dorsal mesh pocket, an insulated pocket, a plurality of animal feature-shaped pockets;

a plurality of aesthetic displays;

a plurality of aesthetic ornaments;

the main animal-shaped body comprises a head-shaped portion, a neck-shaped portion, a torso-shaped portion, and a club-receiving cavity;

the club-receiving cavity comprises an opening;

the club-receiving cavity traversing from the head-shaped portion to the torso-shaped portion through the neck-shaped portion;

the opening being positioned on the head-shaped portion;

the visor-shaped divider being circumferentially mounted into the opening;

the plurality of animal feature-shaped pockets comprises a mouth-shaped pocket;

the towel holder being retractably mounted into the mouth-shaped pocket;

the dorsal mesh pocket being mounted onto the torso-shaped portion;

the insulated pocket being mounted onto the torso-shaped portion, opposite to the dorsal mesh pocket;

the plurality of aesthetic displays comprises a plurality of eye-shaped displays, a nose-shaped display, and at least one logo display;

the plurality of eye-shaped displays being mounted adjacent to the mouth-shaped pocket;

the nose-shaped display being mounted in between the plurality of eye-shaped displays and the mouth-shaped pocket;

the at least one logo display being mounted onto the insulated pocket;

the plurality of aesthetic ornaments comprises a bowtie, a plurality of animal feet-shaped ornaments, and a button-down shirt-shaped ornament;

the bowtie being circumferentially and removably attached to the neck-shaped portion;

the plurality of animal-feet shaped ornaments being mounted adjacent to a rigid base;

the button-down shirt-shaped ornament being mounted onto the torso-shaped portion; and the button-down shirt-shaped ornament traversing from the bowtie to the insulated pocket.

12. The animal-shaped golf bag as claimed in claim 11 further comprises:

a rigid base; and the rigid base being connected adjacent to the torso-shaped portion, opposite to the neck-shaped portion.

13. The animal-shaped golf bag as claimed in claim 11 further comprises:

a carry handle;

a carry strap;

the carry handle comprises a first handle end and a second handle end;

the first handle end being connected to the head-shaped portion;

the second handle end being connected to the neck-shaped portion;

the carry strap comprises a first strap end and a second strap end;

the first strap end being removably attached to the head-shaped portion, adjacent to the visor-shaped divider; and the second strap end being removably attached to the torso-shaped portion, adjacent to a rigid base.

14. The animal-shaped golf bag as claimed in claim 11 further comprises:

the plurality of animal feature-shaped pockets further comprises at least one left shoulder-shaped pocket, at least one right shoulder-shaped pocket, a tail-shaped pocket, and at least one hindquarter-shaped pocket;

the at least one left shoulder-shaped pocket, the at least one right shoulder-shaped pocket, the tail-shaped pocket, and the at least one hindquarter-shaped pocket being mounted onto the torso-shaped portion;

the at least one right shoulder-shaped pocket being positioned opposite to the at least one left shoulder-shaped pocket;

the dorsal mesh pocket being positioned in between the at least one left shoulder-shaped pocket and the at least one right shoulder-shaped pocket;

the tail-shaped pocket being positioned in between the dorsal mesh pocket and a rigid base; and the at least one hindquarter-shaped pocket being positioned in between the tail-shaped pocket and the rigid base.

15. The animal-shaped golf bag as claimed in claim 11 further comprises:

the plurality of animal feature-shaped pockets further comprises at least one left ear-shaped pocket and at least one right ear-shaped pocket;

the at least one left ear-shaped pocket and the at least one right ear-shaped pocket being mounted onto the head-shaped portion; and the at least one right ear-shaped pocket being positioned opposite to the at least one left ear-shaped pocket.

16. An animal-shaped golf bag comprises:

a main animal-shaped body;

a visor-shaped divider;

a towel holder;

a dorsal mesh pocket, an insulated pocket, a plurality of animal feature-shaped pockets;

a plurality of aesthetic displays;

a plurality of aesthetic ornaments;

the main animal-shaped body comprises a head-shaped portion, a neck-shaped portion, a torso-shaped portion, and a club-receiving cavity;

the club-receiving cavity comprises an opening;

the club-receiving cavity traversing from the head-shaped portion to the torso-shaped portion through the neck-shaped portion;

the opening being positioned on the head-shaped portion;

the visor-shaped divider being circumferentially mounted into the opening;

the plurality of animal feature-shaped pockets comprises a mouth-shaped pocket;

the towel holder being retractably mounted into the mouth-shaped pocket;

the dorsal mesh pocket being mounted onto the torso-shaped portion;

the insulated pocket being mounted onto the torso-shaped portion, opposite to the dorsal mesh pocket;

the plurality of aesthetic displays comprises a plurality of eye-shaped displays, a nose-shaped display, and at least one logo display;

the plurality of eye-shaped displays being mounted adjacent to the mouth-shaped pocket;

the nose-shaped display being mounted in between the plurality of eye-shaped displays and the mouth-shaped pocket;

the at least one logo display being mounted onto the insulated pocket;

the plurality of aesthetic ornaments comprises a bowtie, a plurality of animal feet-shaped ornaments, and a button-down shirt-shaped ornament;

the bowtie being circumferentially and removably attached to the neck-shaped portion;

the plurality of animal-feet shaped ornaments being mounted adjacent to a rigid base;

the button-down shirt-shaped ornament being mounted onto the torso-shaped portion; and the button-down shirt-shaped ornament traversing from the bowtie to the insulated pocket.

17. The animal-shaped golf bag as claimed in claim 16 further comprises:

a rigid base;

a carry handle;

a carry strap;

the rigid base being connected adjacent to the torso-shaped portion, opposite to the neck-shaped portion;

the carry handle comprises a first handle end and a second handle end;

the first handle end being connected to the head-shaped portion;

the second handle end being connected to the neck-shaped portion;

the carry strap comprises a first strap end and a second strap end;

the first strap end being removably attached to the head-shaped portion, adjacent to the visor-shaped divider; and the second strap end being removably attached to the torso-shaped portion, adjacent to a rigid base.

18. The animal-shaped golf bag as claimed in claim 16 further comprises:

the plurality of animal feature-shaped pockets further comprises at least one left shoulder-shaped pocket, at least one right shoulder-shaped pocket, a tail-shaped pocket, and at least one hindquarter-shaped pocket;

the at least one left shoulder-shaped pocket, the at least one right shoulder-shaped pocket, the tail-shaped pocket, and the at least one hindquarter-shaped pocket being mounted onto the torso-shaped portion;

the at least one right shoulder-shaped pocket being positioned opposite to the at least one left shoulder-shaped pocket;

the dorsal mesh pocket being positioned in between the at least one left shoulder-shaped pocket and the at least one right shoulder-shaped pocket;

the tail-shaped pocket being positioned in between the dorsal mesh pocket and a rigid base; and the at least one hindquarter-shaped pocket being positioned in between the tail-shaped pocket and the rigid base.

19. The animal-shaped golf bag as claimed in claim 16 further comprises:

the plurality of animal feature-shaped pockets further comprises at least one left ear-shaped pocket and at least one right ear-shaped pocket;

the at least one left ear-shaped pocket and the at least one right ear-shaped pocket being mounted onto the head-shaped portion; and the at least one right ear-shaped pocket being positioned opposite to the at least one left ear-shaped pocket.

* * * * *